US005195833A

United States Patent [19]

Schmeykal et al.

[11] Patent Number: 5,195,833

[45] Date of Patent: Mar. 23, 1993

[54] TYPEWRITER OR SIMILAR MACHINE

[75] Inventors: Rudolf Schmeykal, Hemhofen; Johannes Haftmann, Schwabach, both of Fed. Rep. of Germany

[73] Assignee: Ta Triumph-Adler Aktiengesellschaft, Nuremberg, Fed. Rep. of Germany

[21] Appl. No.: 227,535

[22] Filed: Aug. 1, 1988

[30] Foreign Application Priority Data

Sep. 2, 1987 [DE] Fed. Rep. of Germany ..... 3729308

[51] Int. Cl.[5] ..... B41J 23/34; B41J 35/12; B41J 35/22

[52] U.S. Cl. ..... 400/185; 400/214

[58] Field of Search ..... 400/216.1, 216, 185, 400/214; 318/115

[56] References Cited

U.S. PATENT DOCUMENTS

| | | | |
|---|---|---|---|
| 4,099,106 | 7/1978 | Nikaido | 318/115 |
| 4,234,831 | 11/1980 | Kemmer et al. | 318/115 |
| 4,502,802 | 3/1985 | Kuzuya | 400/216.1 |

FOREIGN PATENT DOCUMENTS

| | | | |
|---|---|---|---|
| 107169 | 5/1984 | European Pat. Off. | 400/144.2 |
| 179405 | 4/1986 | European Pat. Off. | 400/216.1 |
| 8016613 | 1/1982 | Fed. Rep. of Germany . | |
| 3539443 | 2/1987 | Fed. Rep. of Germany . | |
| 3538017 | 4/1987 | Fed. Rep. of Germany . | |
| 2306836 | 11/1976 | France | 400/216.1 |
| 123569 | 6/1986 | Japan | 400/216 |

OTHER PUBLICATIONS

IBM Technical Disclosure Bulletin, vol. 26, No. 1, Jun. 1983.

Arter et al., (Arter) *IBM Technical Disclosure Bulletin*, "Stepping Motor With Shaft To Translation", vol. 26, No. 4, Sep. 1983, pp. 1897–1898.

*Primary Examiner*—Edgar S. Burr
*Assistant Examiner*—Moshe I. Cohen
*Attorney, Agent, or Firm*—Browdy and Neimark

[57] ABSTRACT

A typewriter or similar machine with a ribbon and, if required, a correction tape on a pivotable support which can be lifted or lowered, the ribbon or the correction tape being movable in steps. The pivoting of the ribbon is necessary in order to give a view of the typed text. Since it is selectively possible to type or to correct, it is necessary to lift the support for the ribbon or the correction tape to different levels, so that the particular ribbon required is opposite the line to be printed. The transport of the ribbons as well as the lifting of the support is performed by means of a reciprocation-rotation motor. The respective rotational movement of the reciprocation-rotation motor is preferably transferred to one of the ribbons by toothed wheels. The ribbon can be moved on far enough so that a fresh ribbon surface is available. The same can be done for the correction tape. Depending on whether typing or correction is to take place, the support is pivoted by a set angular amount by means of the displaceable motor shaft, so that either the ribbon or the correction ribbon are at the level of the line to be printed. A simple construction with only a few components is assured by this design. Overriding clutches assure that, depending on the rotational direction of the motor, only one of the other of the ribbons is transported.

5 Claims, 1 Drawing Sheet

TYPEWRITER OR SIMILAR MACHINE

BACKGROUND OF THE INVENTION

1. Field of the Invention

The invention relates to a typewriter or similar machine with a ribbon or, if required, correcting tape movable upwardly and downwardly on a pivotable support, the ribbon or tapes being movable in steps.

2. The Prior Art

Customarily, in connection with the transport of the ribbon and for lifting the ribbon in relation to the platen to the line to be printed, either two different drives were required or, if only one drive was used, corresponding transfer means had to be provided. Often motors or magnets are used as a drive means. The transfer means are, for example, Bowden cables. Such a device can be seen, for example, in German Patent DE-PS 30 23 474. One look at the drawing already makes it singularly clear that a large amount of individual components are required to construct that device. It must also be remembered that these components must be installed. Added to this is that in their entirety they represent a comparatively large mass which is in particular disadvantageous when dealing with a typewriter in which the typing element is disposed on a carriage moving along the platen. In this case all these components must also be disposed on the carriage.

SUMMARY OF THE INVENTION

It is an object of the invention to provide a device consisting of only a few components and not requiring complicated transfer elements, such as drive chains, etc. In addition, control means for operation of the machine should be kept as simple as possible. Regardless, a reliable operation is to be assured, such as is essential in a high-quality typewriter.

Suitable for this is the design of a device of the type in which the drive for transporting the ribbon or the correction tape and for the pivoting of the support is provided in the form of a reciprocation-rotation motor.

Such reciprocation-rotation motors are known, for example, from German Published, Non-Examined Application DE-OS 35 38 017. Such a motor is particularly suitable when it is in the form of a step motor, since this results in a transport step particularly adjustable for the ribbon. For an optimum use of the ribbon it is required that it be moved forward only to the extent that the movement step corresponds to the width of the letter. If required, this can also be a proportional step, the irregular steps of which are controlled by a microprocessor. Otherwise it is sufficient if the reciprocation-rotation motor is disposed on the support for the ribbon or the correction tape and if its rotatable and axially displaceable shaft is supported on the carriage. This results in simple installation and the parts requirement is kept at a minimum. Because in such motors the rotational movement of the rotor and the axial movement of the motor shaft can be temporally superimposed, no problems arise with respect to the temporal course of the different operations, transporting and lifting of the ribbon or the correcting tape.

A preferred embodiment of the drive for a ribbon and correcting tape is attained wherein the rotational movement of the motor shaft is transferable via toothed wheels to the ribbon or correction tape, oppositely acting overriding clutches respectively connecting or disconnecting a drive, depending on the rotational direction of the reciprocation-rotation motor. This design assures that, depending on the choice of the rotational direction of the reciprocation-rotation motor, only one of the tapes is moved. This results in optimal use of the ribbon capacity.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWING

The invention of the present application will not be described in more detail with reference to the preferred embodiments of the device, given only by way of example, and with reference to the accompanying drawings, in which.

DETAILED DESCRIPTION OF THE PREFERRED EMBODIMENT

Figure 1:
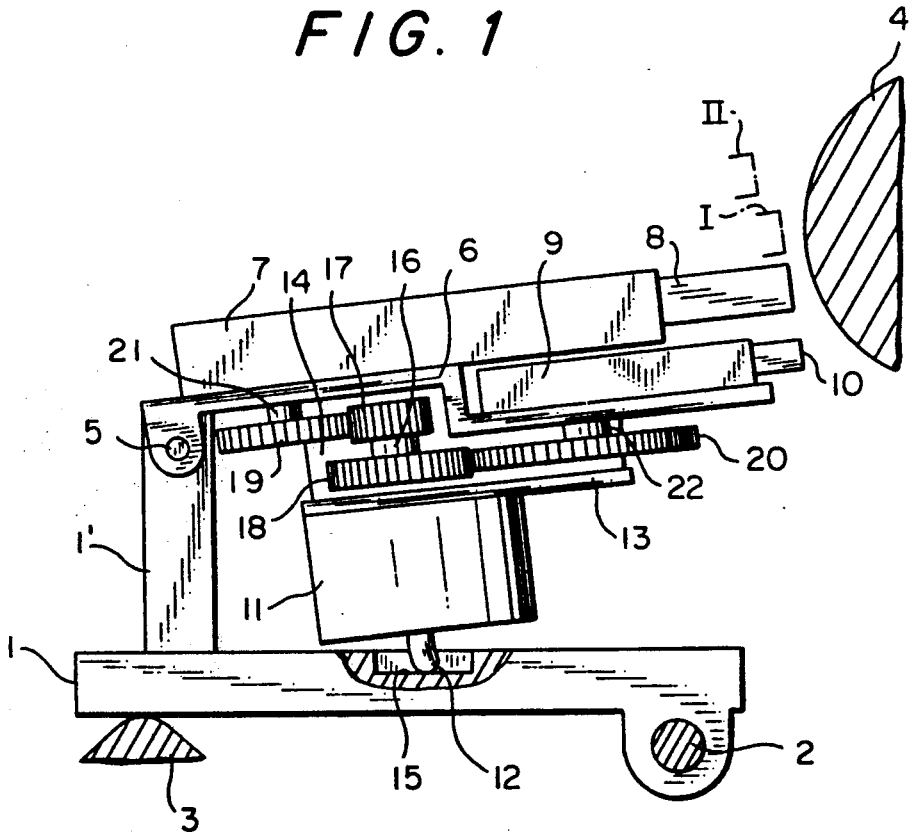
FIGURE 1 illustrates a schematic partially cut side view of a carriage according to an exemplary embodiment of the invention.

The carriage 1 is movable along the platen 4 on a guide rail 2 and a sliding rail 3. Its drive elements are not shown because they have nothing to do with the present invention. The support 6 is pivotably disposed at the pin 5 on bearings or supports 1' disposed on the carriage 1. The ribbon cassette 7 with the ribbon 8 is mounted in the manner known on the support 6. In typewriters with a correcting feature the correcting tape 10 is disposed below the ribbon cassette 7, for example also in a cassette 9. Depending on how far the support 6 with the cassettes 7 and 9 is moved, either the ribbon 8 or the correcting tape 10 gets to the level of the line to be printed.

A reciprocation-rotation motor 11 with an axially displaceable shaft 12 is disposed on the bearing 13. In the drawing of the exemplary embodiment it is also disposed on the support 6 by means of cheeks 14. The shaft 12 downwardly projecting from the reciprocation-rotation motor 11 is supported on a surface 15 on the carriage 1.

The other end of the motor shaft 12 projecting upwardly from the reciprocation-rotation motor 11 engages a sleeve 16. The connection between the motor shaft 12 and the sleeve 16 has been chosen such that the sleeve participates in the rotational movement of the shaft but not in its axial displacement. This means that the motor shaft 12 is longitudinally displaceable within the sleeve 16. Two toothed wheels 17 and 18 are disposed on the sleeve 16 which are respectively in engagement with further toothed wheels 19 and 20 pivotably disposed on the support 6. The axes 21 and 22 of wheels 19 and 20, respectively, are respectively provided with overriding clutches working in opposite directions and not shown in detail. These overriding clutches cause axial pins upwardly extending through the support 6 to be respectively moved in one direction of turning of the reciprocation-rotation motor 11. These axial pins are connectable in a known manner with corresponding elements on the ribbon cassette 7 or the correcting tape cassette 9. In this way, depending on the turning direction of the rotor of the reciprocation-rotation motor 11, only one of the ribbons 8 or 10 is driven. FIGURE 1 shows in solid lines the ribbon 8 and the correction tape 10 in the lowest position. This position is assumed to give the operator a view of the line being typed. In order to print, the ribbon 8 must be lifted to the position I shown in dash-dotted lines. For this purpose the motor shaft 12 is downwardly moved out of the reciprocation-rotation motor 11 by means of electronic control. This causes the support 6 with the ribbon cassette 7 and the correction tape cassette 9, the toothed wheels 17, 19, 18, and 20 and the motor 11 to pivot around the axle pin 5. When a correction is to be made, the shaft 12 is moved further out of the motor 11 so that the ribbon attains position II, also indicated by dash-dotted lines. In this position of the support 6 the correction tape 10 is on the level of the line being printed. A correction can now be made.

As already mentioned, the functions "lifting of the support 6" and "ribbon and correction tape transport" can take place temporally superimposed. Of course it is also possible to perform the functions one after the other.

Normally a correction device is not required in printers. In this case a correspondingly designed reciprocation-rotation motor can be used to only transport the ribbon and to lift it to the line being printed. The lift control of the motor can be so selected that during a rapid succession of individual printing steps the ribbon 8 remains in the raised position and is lowered only if no further impression is made within a defined, preset period of time. This automatically frees the view of the typed text. As shown in the drawing this device makes do with very few components. No transfer elements are required except for the toothed wheels and the overriding clutches. This results in a very simple and uncomplicated assembly. The toothed wheels 17 and 19 or 18 and 20 and certain other parts, for example the support 6 and the carriage 1 can easily be made of plastic. Because of the fact that the support 6 is supported on one side only on the pivot pin 5, the result is a mass which returns into the base position without the aid of springs when the motor shaft 12 moves back into the reciprocation-rotation motor 11. This, too, simplifies the assembly of the entire device.

As typing element for a typewriter designed in this way a, for instance, print wheel would be suitable, which cannot be seen from the drawing.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A typewriter or similar machine comprising a pivotable support for supporting at least one tape means so as to move said at lest one tape means upwardly and downwardly, said at least one tape means being moveable in steps; and a reciprocation-rotation motor for transporting said at least one tape means into upward and downward positions by pivoting said pivotable support, wherein the reciprocation-rotation motor comprises a motor shaft and the machine further comprises a drive means for driving said at least one tape means, toothed wheels for transferring he rotational movement of the motor shaft to said at lest one tape means, and oppositely acting overriding clutches respectively for connecting or disconnecting the drive, responsive to the rotational direction of the reciprocation-rotation motor.

2. The machine in accordance with claim 1, wherein said at least one tape means comprises a ribbon cassette having a ribbon therein.

3. The machine in accordance with claim 2, wherein said at least one tape means further comprises a correcting tape cassette having a correcting tape therein.

4. A typewriter having at least one ribbon means moveable upwardly and downwardly in steps comprising:

a pivotable support for supporting the at lest one ribbon means; and a reciprocation-rotation motor pivoting said support and transporting the at least one ribbon means to an in use position, wherein the reciprocation-rotation motor comprises a motor shaft and the machine further comprises a drive means for driving said at least one ribbon means, a plurality of toothed wheels for transferring the rotational movement of the motor shaft to the at least one ribbon means, and oppositely acting overriding clutches respectively for connecting or disconnecting the drive, responsive to the rotational direction of the reciprocation-rotation motor.

5. The machine in accordance with claim 4, wherein the at least one ribbon means comprises a ribbon and a correcting tape.

* * * * *